United States Patent [19]

Hart

[11] 4,431,390

[45] Feb. 14, 1984

[54] CONDENSATION CONTROL APPARATUS FOR OIL-FLOODED COMPRESSORS

[75] Inventor: John E. Hart, Mooreville, N.C.

[73] Assignee: Dresser Industries, Inc., Dallas, Tex.

[21] Appl. No.: 314,154

[22] Filed: Oct. 23, 1981

[51] Int. Cl.[3] ..... F04C 29/02; F04C 29/04

[52] U.S. Cl. ..... 418/84; 418/85

[58] Field of Search ..... 418/84, 85, 87; 417/228

[56] References Cited

U.S. PATENT DOCUMENTS

| | | | |
|---|---|---|---|
| 2,701,684 | 2/1955 | Hirsch | 418/84 |
| 3,785,755 | 1/1974 | Novak et al. | 418/85 |
| 3,945,464 | 3/1976 | Sato | 184/6.16 |
| 4,289,461 | 9/1981 | Van Oorschot et al. | 418/84 |

FOREIGN PATENT DOCUMENTS

| | | | |
|---|---|---|---|
| 2715610 | 10/1977 | Fed. Rep. of Germany | 418/85 |

*Primary Examiner*—John J. Vrablik

*Attorney, Agent, or Firm*—Roy L. Van Winkle

[57] ABSTRACT

The condensation control device includes sensors for measuring system pressure, ambient temperature and relative humidity for computing the saturation temperature of gas in the system. It also includes a sensor for sensing the system temperature which is compared with the saturation temperature to generate a signal that causes the opening of a valve in a by-pass conduit permitting cooling oil to by-pass a heat exchanger. Thus, the temperature in the compressor system is raised above the saturation temperature and avoids the formation of condensate in the system.

2 Claims, 2 Drawing Figures

CONDENSATION CONTROL APPARATUS FOR OIL-FLOODED COMPRESSORS

BACKGROUND OF THE INVENTION

This invention relates generally to oil-flooded compressor systems. More particularly, but not by way of limitation, this invention relates to an oil-flooded compressor system that includes condensation control apparatus.

Oil flooding in screw or rotary compressors or the like, has been known for many years. The oil provides lubrication and cooling for the compressor as well as promoting a better seal within the compressor. When air or gas is compressed in the compressor, the discharged medium is a gas and oil mixture which, in many applications, has to be separated. If the temperature in the compressor system drops below the saturation temperature or condensation point of the air, water, condensed from the air, will mix with the oil. Upon agitation, the oil and water forms an emulsion that destroys or severely reduces the effectiveness of the oil. Condensate may also cause serious corrosion problems in the compressor system.

The condensation problem has been recognized and it has been proposed that the temperature of the system simply be maintained above the condensation temperature, thereby avoiding the formation of condensate. This solution seems relatively simple, but oil is rendered ineffective much more rapidly with increases in temperature. The oil must be changed frequently or the compressor cannot be operated for extended periods. Also, the ambient temperature and relative humidity, both affecting saturation temperature, are constantly changing during the operation of the compressor.

SUMMARY OF THE INVENTION

It is, therefore, one object of this invention to provide a condensate control system for oil-flooded compressor systems that continually monitors various parameters affecting the condensation or saturation temperature, and controls the system temperature so that it will remain just above the saturation temperature, thereby prolonging the life and effectiveness of the oil and avoiding the formation of condensate in the system.

This invention provides an oil-flooded compressor system that includes a compressor, an oil pump, a receiver, a heat exchanger, and condensation control apparatus. The condensation control apparatus includes: a compressor discharge conduit that extends from the compressor to the receiver; a first oil conduit that extends from the compressor to the heat exchanger; and a second oil conduit that extends from the receiver to the heat exchanger. A by-pass conduit extends from the first oil counduit to the second oil conduit and includes a normally closed valve located in the by-pass conduit that permits oil flow therethrough when open. A temperature transducer is connected to the receiver for transmitting a signal indicative of the system temperature. Valve control means is connected with the normally closed valve and with the transducer for receiving the system temperature signal and includes means for determining the saturation temperature in the system and produces a signal corresponding to the saturation temperature. The saturation temperature signal is compared with the system temperature signal and a control signal is transmitted to the valve when the saturation temperature is higher than the system temperature causing the valve to open. Opening of the valve permits oil flow through the by-pass conduit raising the temperature in the system. The temperature in the system is raised until it is above the saturation temperature and thus, condensation cannot be formed in the compressor system.

BRIEF DESCRIPTION OF THE DRAWING

The foregoing and additional objects and advantages of the invention will become more apparent when the following detailed description is read in conjunction with the accompanying drawing wherein like reference characters denote like parts in all views, and wherein.

DETAILED DESCRIPTION OF THE PREFERRED EMBODIMENT

Figure 1:
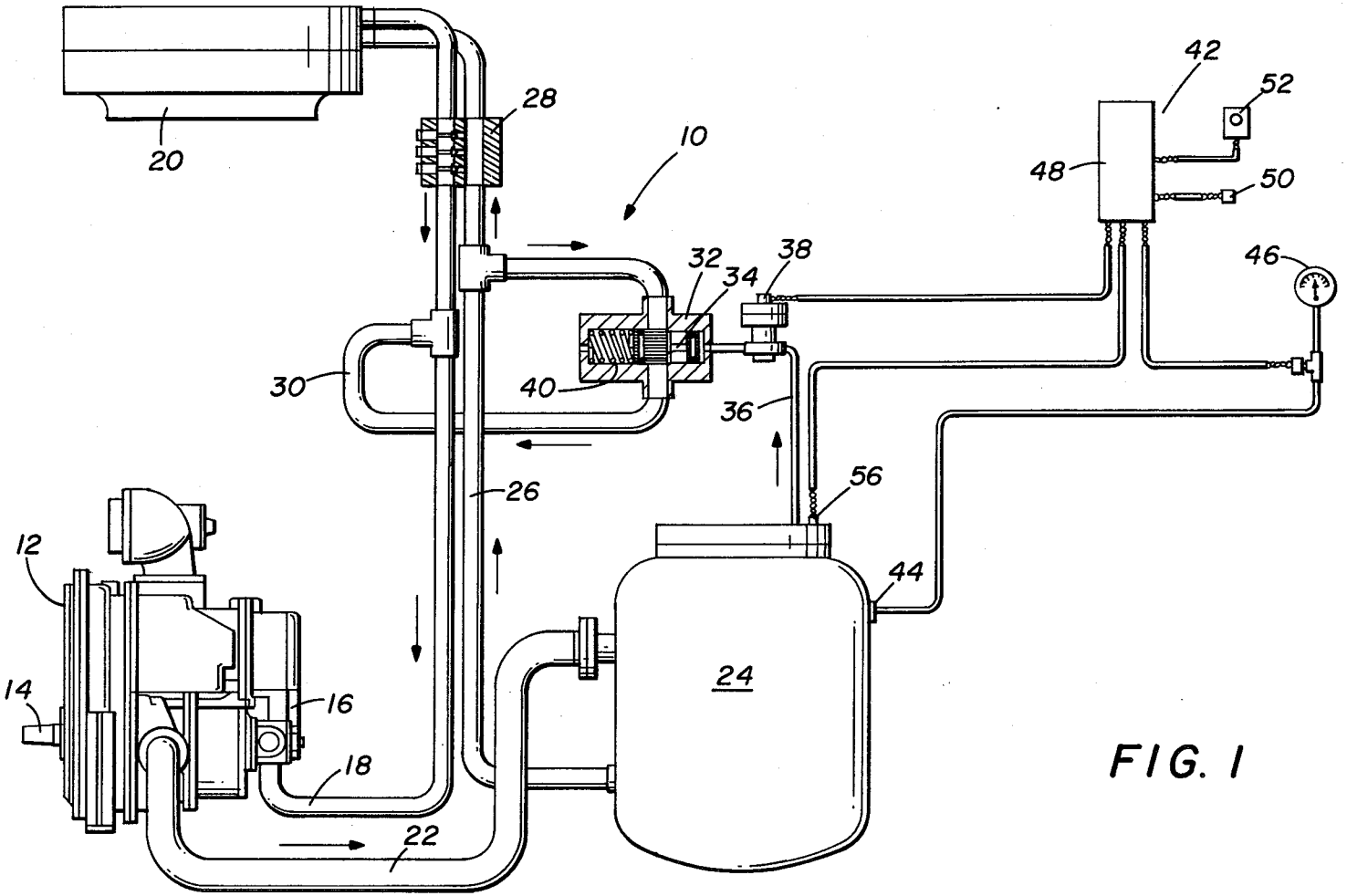
FIG. 1 is a schematic drawing of a compressor system incorporating condensation control apparatus that is constructed in accordance with the invention.

Referring to the drawing and to FIG. 1 in particular, shown therein and generally designated by the reference character 10, is a compressor system that includes an oil-flooded compressor 12 that is arranged to be driven through an input shaft 14. The compressor 12 includes an oil pump 16 that is connected to a conduit 18 that extends from the compressor 12 to a heat exchanger or oil cooler 20. The compressor 12 also includes a discharge conduit 22 that extends from the compressor 12 to a receiver 24.

The receiver 24 also functions as a separator to remove the oil from the air/oil mixture discharged by the compressor 12, as a collector for the compressed gas, and as a reservoir for holding the oil that is used for oil flooding the compressor 12. The receiver 24 is connected by a conduit 26 with the oil cooler 20.

An optional thermostatically controlled by-pass valve 28 is located in the conduits 18 and 26 adjacent to the oil cooler 20. The by-pass valve 28 is generally set to operate at about 140° F. and, should the oil in the conduits 18 or 26 drop below that temperature, the valve 28 will open permitting oil to flow from the conduit 28 to the conduit 18 by-passing the oil cooler 20 and thus increasing the temperature of the oil in the system.

Similarly, a by-pass conduit 30 extends between the conduits 18 and 26 providing for flow therebetween when certain events which will be described occur. Located in the by-pass conduit 30 is a normally closed valve 32, which in the closed position, prevents flow from the conduit 18 to the conduit 26.

The valve 32 as illustrated, is pneumatically actuated and includes a valve member 34 that is responsive to air pressure from an air line 36. The air line 36 extends from the receiver 24 to the valve 32 via a solenoid actuated valve 38. The valve 38 must be opened to impose air pressure on the valve member 34 to open the valve 32. A spring 40 located in the valve 32 maintains the valve member 34 in the normally closed position.

The compressor system 10 also includes condensation control apparatus generally designated by the reference character 42 which generates the signal for opening the valve 32. In its preferred form, the apparatus 42 is accomplished by the use of electronics and that will be the system described generally hereinafter.

To control the condensation in the compressor system, it is necessary to establish the condensation or saturation temperature and compare that with the temperature in the system. If the temperature in the system is below the saturation temperature, condensation will occur. Therefore, and as previously mentioned, it is necessary to maintain the system temperature at a point above the saturation temperature so that condensation cannot occur.

The factors entering into the determination of the saturation temperature (SAT) are: the relative humidity (RH); the ambient temperature (AT); and the system pressure (SP). Accordingly, and as can be seen in FIG. 1, a sensor or transducer 44 is connected to the receiver 24 for determining the system pressure (SP) and transmitting a signal indicative of such pressure. The pressure transducer 44 is connected both to a pressure gauge 46, which indicates the system pressure visually, and to a computing module 48 which contains the necessary electronics to carry out certain functions that will be described.

The ambient temperature (AT) is obtained by an ambient temperature transducer 50 which transmits a signal indicative of such temperature to the module 48. The ambient temperature sensor 50 is generally located adjacent to compressor 12.

Figure 2:
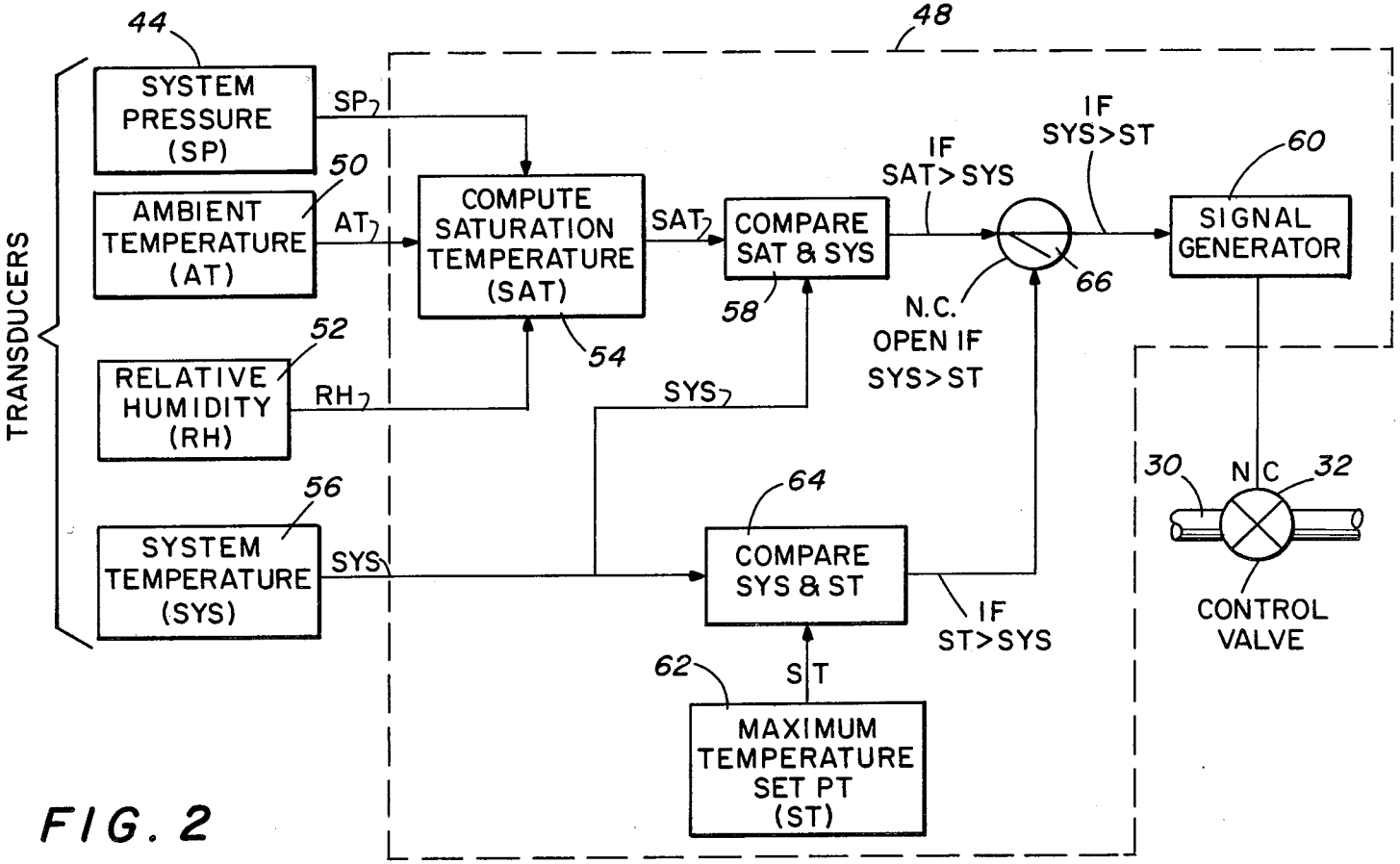
FIG. 2 is a logic or flow diagram illustrating the operation of part of the condensation control apparatus.

The relative humidity (RH) is determined by a relative humidity transducer 52 that is likewise connected to the module 48 and is constructed to transmit a signal that is indicative of the relative humidity adjacent to the compressor 12. Referring to FIG. 2, it can be seen that the system pressure (SP), ambient temperature (AT), and relative humidity (RH), are combined in a portion 54 of the module 48 to provide a signal that is indicative of the saturation temperature (SAT).

The system temperature signal (SYS) is provided by a temperature sensor or transducer 56 that is connected to the receiver 24 and that transmits a signal indicative of the temperature in the system to the module 48 where such signal is compared in a comparator 58 with the saturation temperature (SAT) and transmits a signal if the saturation temperature is equal to or exceeds the system temperature, that is, if $SAT \geqq SYS$. The signal is transmitted to a signal generator 60 located in the module 48 which is connected with the solenoid valve 38. The valve 38 actuates the normally-closed valve 32 for a pre-determined period of time, which is determined by a clock or timer (not shown) in the module 48. Such period of time is based on the required volume of oil flow to cause the system temperature (SYS) to increase by a distinct value. After the time period, the foregoing is repeated and the valve 32 reopened if necessary to further increase the system temperature if it remains below the saturation temperature (SAT).

Also, illustrated in FIG. 2 is a safety device that is provided if desired to prevent overheating of the compressor 12. As illustrated, the module 48 includes a maximum temperature set point device 62. The signal (ST) from the set point device is combined or compared with the system temperature (SYS) in a comparator 64. If the set point (ST) exceeds the system temperature (SYS), a signal is transmitted to a normally closed switch 66 that is located between the comparator 58 and the signal generator 60. Opening of the switch 66 prevents a signal from reaching the signal generator 60 and thus the valve 32 remains in the normally closed position with oil in the system being circulated through the oil cooler 20. Although not shown, and if desired, the signal (ST) could also light a warning light, actuate an alarm system, or shut-down the compressor system.

OPERATION OF THE PREFERRED EMBODIMENT

It is believed that the operation of the condensate control system is readily apparent from the foregoing, but the following may help to clarify the various functions of the system. At the start-up of the compressor 12, the oil in the system will be cold so that the condensate control system 42 will be sensing through the system temperature transducer 56 that the system temperature (SYS) is below the saturation temperature (SAT) and thus a signal is transmitted to the solenoid valve 38 to open the normally-closed valve 32 so that oil in the system flows from the receiver 24 through the conduit 26 into the by-pass 30 into the conduit 18, through the oil pump 16 and into compressor 12.

In the event that the thermostatic by-pass 28 is used, that valve will also be open permitting additional fluid to by-pass the oil cooler 20, flowing from the conduit 26 directly through the valve 28 into the conduit 18 and then to the compressor 12. Since the oil cooler 20 is by-passed, the oil temperature will increase relatively quickly to raise the system temperature (SYS). Simultaneously with the foregoing, the appropriate transducers are sampling the system pressure (SP), the ambient temperaure (AT) and relative humidity (RH) to compute the saturation temperature (SAT) which is compared with the system temperature (SYS).

When the system temperature (SYS) eventually reaches the computed saturation temperature (SAT), a control signal is transmitted to the valve 32 permitting the valve 32 to return to its normal closed position so that the oil is circulated from the conduit 26 through the oil cooler 20 back into the conduit 18 to the compressor 12.

At periods controlled by a timer (not shown), the various parameters are sampled to ascertain whether or not the system temperature (SYS) remains above the saturation temperature (SAT). Of course, if the system temperature (SYS) is below the saturation temperature (SAT), then the normally closed valve 32 will be open to permit by-passing of the oil and again increasing the temperature of the oil to raise the system temperature (SYS) until it is again above the saturation temperature (SAT). This cycle will be repeated at periodic intervals to maintain the system temperature (SYS) at the desired level above the saturation temperature (SAT) while at the same time avoiding the extremely high temperatures which will cause disintegration or destruction of the oil.

From the foregoing detailed description, it should be apparent that the condensate control system does provide means and apparatus that functions to prevent condensation in the compressor system.

Having described but a single embodiment of the invention, it will also be understood that many changes and modifications can be made thereto without departing from the spirit and scope of the invention.

The embodiments of the invention in which an exclusive property or privilege is claimed are defined as follows:

1. In an oil-flooded compressor system including a compressor, an oil pump, a receiver, a heat exchanger and a compressor discharge conduit extending from the compressor to receiver, condensation control apparatus comprising:

a first oil conduit extending from said compressor to said heat exchanger;

a second oil conduit extending from said receiver to said heat exchanger;

a by-pass conduit extending from said first oil conduit to said second oil conduit;

a normally closed valve located in said by-pass conduit for permitting the flow of oil therethrough when open;

temperature transducer means operably connected in the system for transmitting a signal indicative of the system temperature;

valve control means connected with said valve and with said transducer means for receiving said signal, said control means including means for determining the saturation temperature in said system, producing a signal indicative of said saturation temperature and comparing said saturation temperature signal with said system temperature signal, and transmitting a control signal to said valve when said saturation temperature is higher than the temperature in said system, said control signal causing said valve to open permitting oil flow through said by-pass conduit, raising the temperature of said oil to elevate the temperature in said system above said saturation temperature and thereby preventing condensation in the compressor system;

said means for determining the saturation temperature includes a relative humidity transducer for transmitting a signal indicative of ambient relative humidity to said control means; and, said means for determining the saturation temperature also includes a pressure transducer connected to said system for transmitting a signal indicative of the system pressure to said control means.

2. In the system of claim 1, wherein said control means also includes temperature limit means for transmitting a control signal preventing said valve from opening when the system temperature exceeds a predetermined value.

* * * * *